US008434494B1

(12) United States Patent
Gonzalez

(10) Patent No.: US 8,434,494 B1
(45) Date of Patent: May 7, 2013

(54) GRAVITY PIPE FOR SMOKERS

(76) Inventor: Kris Gonzalez, Arleta, CA (US)

( * ) Notice: Subject to any disclaimer, the term of this patent is extended or adjusted under 35 U.S.C. 154(b) by 0 days.

(21) Appl. No.: 13/293,319

(22) Filed: Nov. 10, 2011

(51) Int. Cl.
*A24C 1/42* (2006.01)
*A24C 5/38* (2006.01)
*A24C 5/60* (2006.01)

(52) U.S. Cl.
USPC ..... 131/284; 131/194; 131/173

(58) Field of Classification Search ..... None
See application file for complete search history.

(56) References Cited

U.S. PATENT DOCUMENTS 722,405 A * 3/1903 Ganim ..... 131/173
4,164,950 A * 8/1979 Bechtold ..... 131/194

* cited by examiner

*Primary Examiner* — Richard Crispino
*Assistant Examiner* — Phu Nguyen

(74) *Attorney, Agent, or Firm* — James A. Italia; Italia IP

(57) ABSTRACT

A gravity type water pipe providing enhanced cooling of smoke generated thereby. The water pipe comprises a water reservoir and a movable assembly which in operation is raised and lowered in water contained in the water reservoir. The movable assembly may comprise a vertical conduit, a bowl for containing ignited substances, and an enlarged chamber below the vertical conduit. A supplementary cooling chamber for containing ice is contained in the smoke flow path of the movable assembly. The supplementary cooling chamber is adapted to receive ice and may for example have a grate for entrapping ice cubes place in the supplementary cooling chamber. The supplementary cooling chamber may be a component unto itself which is removable from the movable assembly.

4 Claims, 2 Drawing Sheets

GRAVITY PIPE FOR SMOKERS

FIELD OF THE INVENTION

The present invention relates to water pipes, and more particularly, to those known as gravity operated water pipes.

BACKGROUND OF THE INVENTION

Smoking using hookahs and similar water pipes dates back many years and continues to be enjoyed by smokers. Water pipes have the effect of cooling smoke generated by combustion prior to inhalation, since the generated smoke passes through the water which is typically at ambient temperatures.

In a typical gravity operated pipe smoke is first generated in a small bowl located atop a vertical conduit, which conduit extends to an enlarged chamber open at the bottom. A mouthpiece for inhaling may extend laterally from the conduit. The bowl, conduit, mouthpiece if the latter is used, and the enlarged chamber form a unified movable assembly. The movable assembly is placed in a reservoir partially filled with water. Preferably, the movable assembly is stably supported within the reservoir so that the user need not be obliged to support the movable assembly with two hands.

A combustible substance such as tobacco is placed in the bowl and ignited by a cigarette lighter, match or the like. The movable assembly, which has been resting in the water reservoir and is maximally submerged, is then elevated by hand. This generates a partial vacuum within the enlarged chamber. As the movable assembly is progressively elevated, air containing smoke is drawn from the bowl, through the conduit, and into the open headspace within the enlarged chamber. Care is taken not to elevate the bottom of the enlarged chamber above the upper surface of water contained within the reservoir.

At a suitable degree of upward travel, the user places the mouthpiece in his or her mouth, or in the absence of a separate mouthpiece, the bowl is removed from the upper end of the conduit and the exposed upper end of the conduit is place in the mouth as a substitute for the mouthpiece. The mobile assembly is then manually moved downwardly. This imposes pressure on air and smoke contained in the headspace of the enlarged chamber. Pressurized air and smoke are then forced upwardly through the conduit into the mouth of the user. The user may then breathe in the air and smoke.

The above described cycle may be repeated as desired. Although some people are satisfied with this mode of operation, others feel that cooling the smoke before it is inhaled would enhance the smoking experience. There remains a need in the art to satisfy this latter group of gravity pipe users.

SUMMARY OF THE INVENTION

The present invention addresses the above stated need by introducing an additional cooling chamber to a gravity type pipe. More specifically, the additional cooling chamber may contain ice. Air and smoke are generated conventionally, but are filtered through ice prior to being inhaled. This cools the smoke prior to inhalation.

It is an object of the invention to provide additional cooling to a gravity type pipe.

Another object of the invention is to reduce temperatures of air and smoke to levels below those attainable using only the traditional water reservoir of a gravity type pipe.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
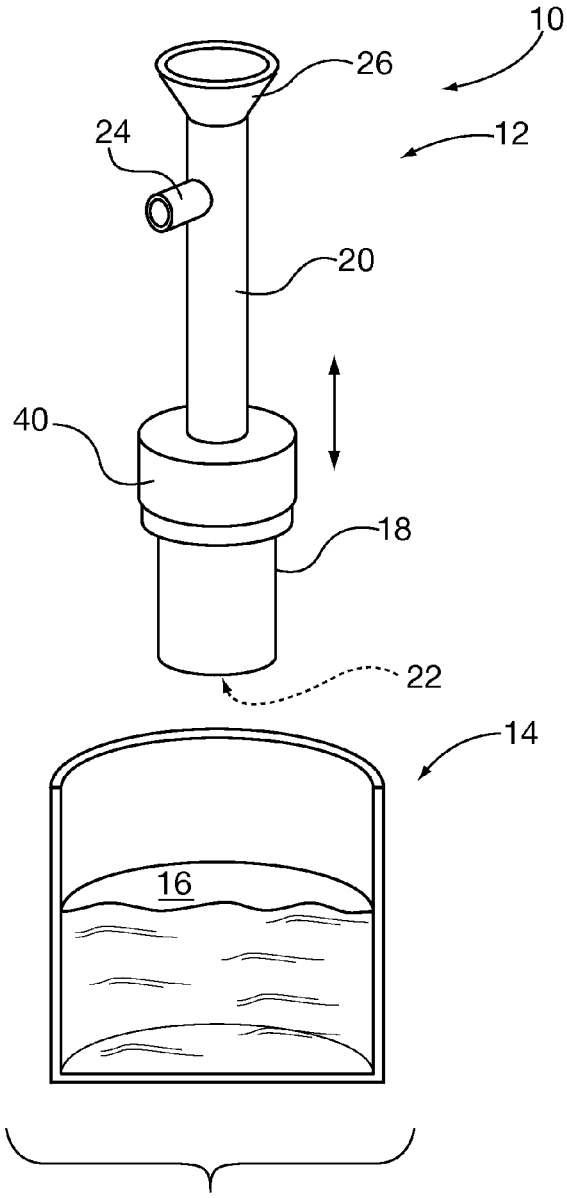
FIG. 1 is an exploded perspective view of a gravity type pipe according to at least one aspect of the invention, shown partially in cross section.

Referring first to FIG. 1, according to at least one aspect of The invention, there is shown a gravity type pipe 10 which according to the present invention is improved over the prior art by providing enhanced cooling of smoke generated within the pipe 10. Typical of gravity type pipes, the water pipe 10 comprises a movable assembly 12 and a water reservoir 14 which is dimensioned and configured to contain water 16. Although not strictly necessary, the movable assembly 12 may comprise an enlarged chamber 18 disposed at the bottom of a vertical conduit 20. As seen in FIG. 1, the vertical conduit 20 projects upwardly from the enlarged chamber 18. The enlarged chamber 18 is in fluid communication with the vertical conduit 20, and has an open bottom end 22. Thus, there is established a continuous open fluid path for air to pass through the movable assembly 12. The enlarged chamber 18 facilitates generation of a partial vacuum when the movable assembly 12 is raised (in the direction of arrow 28), with its open bottom end 22 remaining submerged in the water 16. Responsive to this partial vacuum, air and smoke generated in a bowl 26 pass through the vertical conduit 20 and enter the enlarged chamber 18. The bowl 26, which may be manually removable from the vertical conduit 20, provides a convenient open chamber which receives a combustible substance such as tobacco (not shown), and has an opening at the bottom to preserve continuity of the fluid path for air. Inrush of air responsive to raising the movable assembly 12 supports combustion of the combustible substance once the latter has been ignited and consequential formation of smoke, which smoke then flows downwardly into the enlarged chamber 18.

It should be noted at this point that orientational terms such as left and right refer to the subject drawing as viewed by an observer. The drawing figures depict their subject matter in orientations of normal use, which could obviously change with changes in body posture and position. Therefore, orientational terms must be understood to provide semantic basis for purposes of description, and do not limit the invention or its component parts in any particular way.

When the movable assembly 12 is lowered into the water, air and smoke within the enlarged chamber 18 are subjected to compression, and responsively flow upwardly through the vertical conduit 20. The air and smoke may then be discharged, or inhaled through a discharge port, typically called a mouthpiece 24, which may project laterally from the vertical conduit 20.

Obviously, dimensions and configuration of the movable assembly 12 and of the water reservoir 14 are such as to enable the enlarged chamber 18 to be raised and lowered within the water contained within the enlarged chamber 18 without exposing the open bottom end 22 of the enlarged chamber 18 to ambient air when the movable assembly 12 is raised from a maximally submerged position within the water reservoir 14.

Structure and operation of the pipe 10 presented thus far are conventional. The invention resides in a supplementary cooling chamber 28 which is disposed to contain ice in a convenient form such as ice cubes 30 which are the product of general purpose ice makers and ice cube generators of general purpose refrigerators.

Because the supplementary cooling chamber 28 is interposed within the fluid path of the vertical conduit 20 between the enlarged chamber 18 and the mouthpiece 24, air and smoke generated within the water pipe 10 will pass through the supplementary cooling chamber 28 when the movable assembly 12 is raised and lowered.

Figure 2:
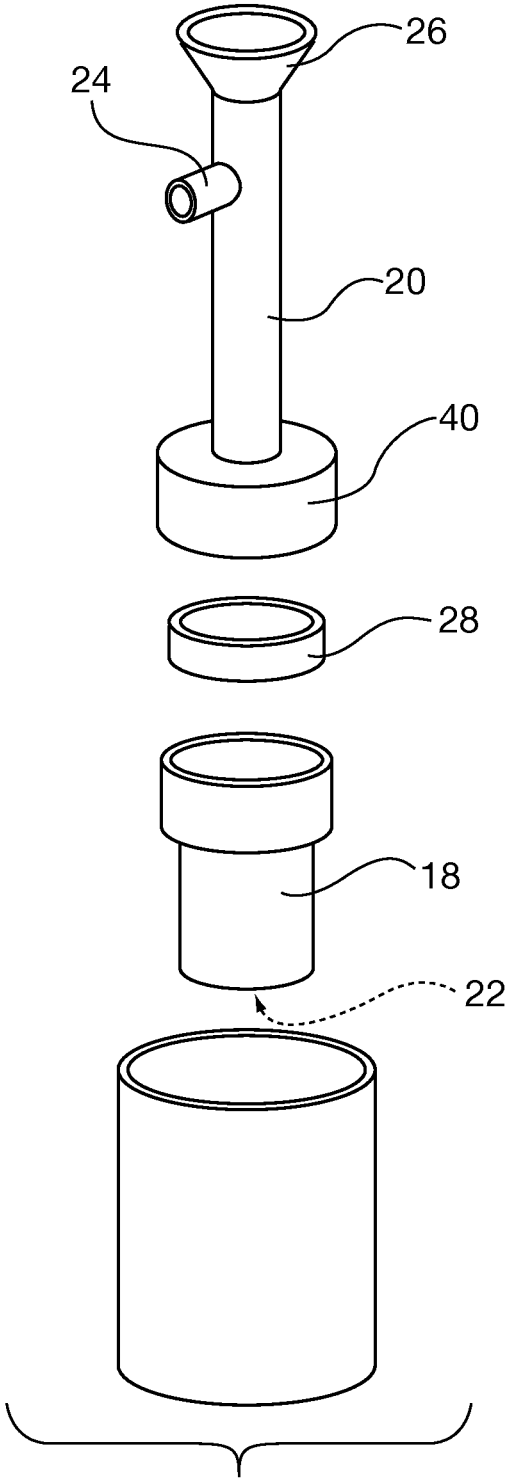
FIG. 2 is a further exploded perspective view of the gravity type pipe of FIG. 1.

While it would be possible to locate the supplementary cooling chamber 28 at any point along the vertical conduit 20, in the particularly advantageous construction shown in FIGS. 1 and 2, the supplementary cooling chamber 28 fits into and is contained within the enlarged chamber 18 in close cooperation therewith.

Figure 3:
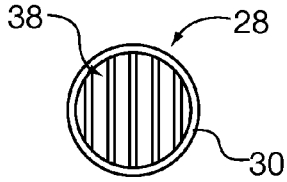
FIG. 3 is a top plan view of a component seen at the center of FIG. 2.
Figure 4:
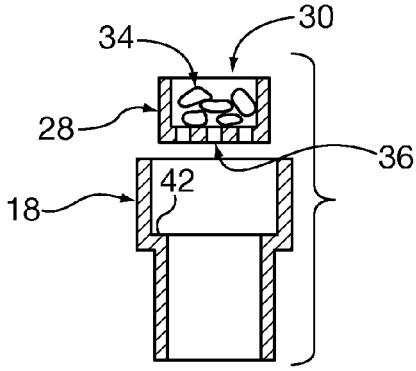
FIG. 4 is a cross sectional side view of two components seen at the center of FIG. 2.

Construction of the supplementary chamber 28 per se is seen in FIGS. 3 and 4. Referring specifically to FIG. 3, the supplementary cooling chamber 28 may have a lateral wall 32 defining an open upper end 34 and an open lower end 36. A grate 38 located at the open lower end 36 to retain the ice cubes 30 while still enabling air and smoke to flow along the fluid path of the vertical conduit 20. The grate 38 has openings which are limited in cross sectional areas so as to retain the ice cubes 30.

The supplementary cooling chamber 28 is received within a space collectively defined by and enclosed within a portion of the enlarged chamber 18 and a cap 40 which is disposed at and may be rigidly fixed to the lower end of the vertical conduit 20. The cap 40 removably fits to and closes the upper end of the enlarged chamber 18 to complete an enclosed space which houses the supplementary cooling chamber 28. Fit of the cap 40 to the enlarged chamber 18 is sufficiently strong as to maintain the enlarged chamber 18 and vertical conduit 20 as a united assembly so as to enable the movable assembly 12 to be manually raised and lowered as described. The supplementary cooling chamber 28 serves as a gas permeable basket which is removable from the enclosed space formed collectively by the enlarged chamber 18 and the cap 40.

The enlarged chamber 18 may be sufficiently deep so as to receive the supplementary cooling chamber 28. Of course, it would be possible to increase the volume of the cap 40 so that the supplementary chamber 28 could be received within the cap 40. In a further variation, the enlarged chamber 18 and the cap 40 could each provide equal volume or space for receiving and enclosing the supplementary chamber 28. For brevity, it may be said that the supplementary cooling chamber 28 is contained within one of the cap 40 and the enlarged chamber 18.

As depicted in FIG. 4, the enlarged chamber 18 may comprise an internal shoulder 42 which prevents the supplementary cooling chamber 28 from falling through the open lower end of the enlarged chamber 18 by interference established by the internal shoulder 42.

The present invention may be thought of not only as an apparatus as described above, but also as a method of using a gravity type pipe such as the water pipe 10. The method may comprise steps of providing a gravity type pipe such as the pipe 10, interposing an ice containing supplementary cooling chamber such as the supplementary cooling chamber 28 within the smoke flow path of the gravity type pipe, and inhaling smoke which has been cooled by flowing past the ice contained in the supplementary cooling chamber.

The method may comprise a further step of placing a plurality of ice cubes such as the ice cubes 30 within the supplementary cooling chamber.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible

I claim:

1. A gravity type pipe providing enhanced cooling of smoke generated within the pipe, comprising:

a movable assembly comprising a vertical conduit having a discharge port for discharging smoke generated within the gravity pipe, a bowl for receiving a combustible substance which is to be ignited to generate smoke, and an enlarged chamber disposed at the bottom of the vertical conduit which is in fluid communication with the vertical conduit, wherein the enlarged chamber has an open bottom end;

a water reservoir which is dimensioned and configured to contain water and to enable the enlarged chamber of the movable assembly to be raised and lowered within the water contained within the enlarged chamber without exposing the open bottom end of the enlarged chamber to ambient air when the movable assembly is raised from a maximally submerged position within the water reservoir;

the vertical conduit disposed in fluid communication with the enlarged chamber and projecting upwardly therefrom and comprises a mouthpiece which projects laterally from the vertical conduit; and a supplementary cooling chamber which is disposed to contain ice, to pass and smoke generated within the gravity pipe through the supplementary cooling chamber, and is interposed between the enlarged chamber and the discharge port of the vertical conduit and is disposed to fit into and is contained within the enlarged chamber in close cooperation therewith;

wherein the enlarged chamber is configured to generate a partial vacuum when the movable assembly is raised while the open bottom end remaining submerged in the water; responsive to the partial vacuum, air and smoke generated in the bowl pass through the vertical conduit and enter the enlarged chamber.

2. The gravity type pipe of claim 1, wherein the supplementary cooling chamber has a lateral wall defining an open upper end and an open lower end, and a grate located at the open lower end.

3. The gravity type pipe of claim 2, wherein the grate has openings limited in cross sectional areas so as to retain ice cubes which are the product of general purpose ice makers and ice cube generators of general purpose refrigerators.

4. The gravity type pipe of claim 1, wherein the supplementary cooling chamber is removable from the movable assembly.

* * * * *